US009764797B2

(12) United States Patent
Kato et al.

(10) Patent No.: US 9,764,797 B2
(45) Date of Patent: Sep. 19, 2017

(54) PERSONAL WATERCRAFT

(71) Applicant: KAWASAKI JUKOGYO KABUSHIKI KAISHA, Kobe-shi, Hyogo (JP)

(72) Inventors: Hironori Kato, Kakogawa (JP); Toshio Araki, Kakogawa (JP); Minoru Kanamori, Rowland Heights, CA (US); Kenichi Ohkita, Kakogawa (JP)

(73) Assignee: Kawasaki Jukogyo Kabushiki Kaisha, Kobe-shi, Hyogo (JP)

( * ) Notice: Subject to any disclaimer, the term of this patent is extended or adjusted under 35 U.S.C. 154(b) by 0 days.

(21) Appl. No.: 15/004,131

(22) Filed: Jan. 22, 2016

(65) Prior Publication Data

US 2017/0210445 A1 Jul. 27, 2017

(51) Int. Cl.

| | |
|---|---|
| ***B63B 1/04*** | (2006.01) |
| ***B63B 35/73*** | (2006.01) |
| ***B63B 1/18*** | (2006.01) |

(52) U.S. Cl.

CPC ..... *B63B 1/04* (2013.01); *B63B 1/18* (2013.01); *B63B 35/731* (2013.01)

(58) Field of Classification Search

CPC B63B 43/00; B63B 43/14; B63B 1/22; B63B 1/20; B63B 39/00; B63B 39/06; B63B 59/00; B63B 59/02; B63B 35/73

USPC ..... 114/61.32, 55.5, 55.54, 126, 283, 284

See application file for complete search history.

(56) References Cited

U.S. PATENT DOCUMENTS

| | | | | |
|---|---|---|---|---|
| 5,743,206 | A * | 4/1998 | Hattori | B63B 1/08 114/55.51 |
| 6,997,128 | B2 | 2/2006 | Matsuda | |
| 7,117,806 | B2 | 10/2006 | Kamio et al. | |

* cited by examiner

*Primary Examiner* — Lars A Olson

(74) *Attorney, Agent, or Firm* — Alleman Hall Creasman & Tuttle LLP

(57) ABSTRACT

A personal watercraft comprises a body including a hull and a deck; a joining section including a horizontal portion protruding horizontally from the body, and a vertical portion protruding downward from an outer end portion of the horizontal portion, the joining section joining the hull to the deck; and a stabilizer mounted to the joining section. The joining section includes right and left joining sections, and a stern joining section. The stabilizer is mounted to a rear portion of at least one of the right and left joining sections. The stabilizer has an inclined bottom surface which is located below a bottom surface of the horizontal portion and extends in a forward and rearward direction such that the inclined bottom surface is inclined in a downward direction as the inclined bottom surface extends in a rearward direction.

4 Claims, 5 Drawing Sheets

PERSONAL WATERCRAFT

BACKGROUND OF THE INVENTION

Field of the Invention

The present invention relates to a personal watercraft.

Description of Related Art

The body of a personal watercraft includes a hull and a deck which are joined together. For example, as disclosed in U.S. Pat. No. 6,997,128, a joining section at which the hull and the deck are joined together is provided to surround the entire periphery of the body (see e.g., Patent Literature 1). The joining section includes a horizontal portion protruding horizontally, and a vertical portion extending downward from the outer end portion of the horizontal portion. The cross-section of the joining section has a hook shape (inverted-L shape).

While the personal watercraft is planing in a forward direction on the water, water flows in a rearward direction and an upward direction from the bottom of the hull, along the side surface of the body. It is likely that the water flows into a groove space which is formed by the right and left joining sections and opened in a downward direction, flows in the rearward direction inside the groove, and collides against the joining section (in particular, the vertical portion of the joining section) provided at a stern, from the front. In this case, a bow is tilted in the downward direction by the force of the water flow, and a resistance (e.g., wave making resistance) applied to the body while the personal watercraft is planing on the water is increased.

SUMMARY OF THE INVENTION

An object of the present invention is to reduce the resistance applied to the body of the personal watercraft while the personal watercraft is planing on the water.

According to an aspect of the present invention, a personal watercraft comprises a body including a hull and a deck, a joining section including a horizontal portion protruding horizontally from the body, and a vertical portion protruding downward from an outer end portion of the horizontal portion, the joining section extending to surround an entire periphery of the body to join the hull to the deck; and a stabilizer mounted to the joining section, and the joining section includes right and left joining sections extending in a forward and rearward direction at a right part and a left part of the body, respectively, and a stern joining section extending in a rightward and leftward direction at a stern of the body, the stabilizer is mounted to a rear portion of at least one of the right and left joining sections, and the stabilizer has an inclined bottom surface which is located below a bottom surface of the horizontal portion and extends in the forward and rearward direction in such a manner that the inclined bottom surface is inclined in a downward direction as the inclined bottom surface extends in a rearward direction.

In accordance with this configuration, since the stabilizer is provided at the rear portion of the right or left joining section, a water flow from the bottom of the hull is guided in the rearward direction along the inclined bottom surface of the stabilizer. The water flow guided in the rearward direction moves in the rearward direction away from the inclined bottom surface of the stabilizer, but does not easily collide against the stern joining section. This makes it possible to prevent the force of the water flow from being exerted on the stern joining section, from the front. As a result, it becomes possible to prevent a situation in which the bow is tilted to the front, and reduce a resistance applied to the body, while the watercraft is planing on the water.

DETAILED DESCRIPTION OF THE PREFERRED EMBODIMENTS

Hereinafter, the embodiment will be described with reference to the drawings. The stated directions are from the perspective of a rider riding on a personal watercraft 1.

Figure 1A:
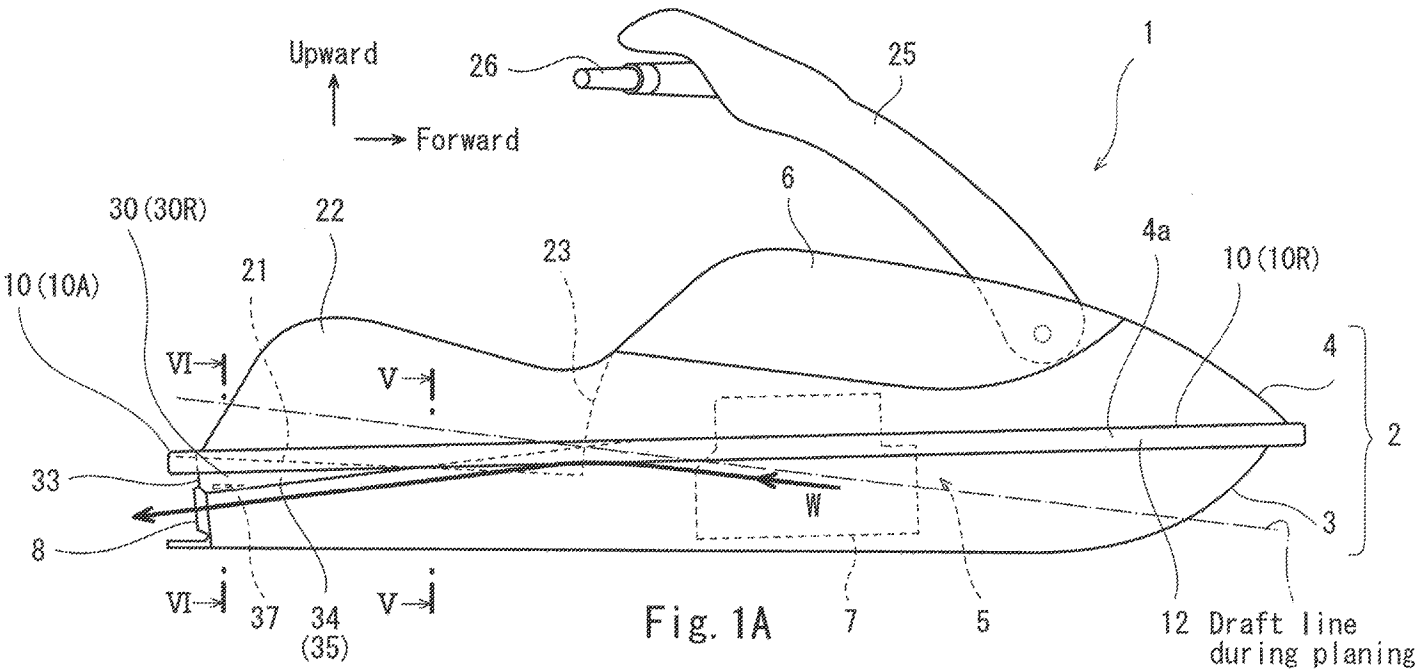
FIG. 1 is a side view of a personal watercraft according to an embodiment.

As shown in FIG. 1A, the personal watercraft 1 includes a body 2 including a hull 3 and a deck 4. An engine room 5 is provided in the interior of the body 2. An engine hood 6 covers from above a maintenance opening (not shown) which is provided in the deck 4 and is in communication with the engine room 5, and is detachably attached to the deck 4. A water jet pump (not shown) is driven by an engine 7 disposed in the engine room 5. The water jet pump pressurizes and accelerates water suctioned through a suction port 3*b* (see FIG. 2) provided in the hull 3. The pressurized and accelerated water is ejected rearward through a jet nozzle 8 attached to the rear end portion of the body 2. In this way, a forward propulsive force is generated in the body 2.

The deck 4 covers the hull 3 from above, and is connected to the hull 3. The body 2 is formed with a joining section 10 by which the hull 3 is joined to the deck 4 in such a manner that the joining section 10 surrounds the entire periphery of the body 2. Hereinafter, the joining section extending in a rightward and leftward direction at a stern will be referred to as a "stern joining section 10A," the joining section extending in a forward and rearward direction at the right part of the body will be referred to as a "right joining section 10R," and the joining section extending in the forward and rearward direction at the left part of the body will be referred to as a "left joining section 10L." The right joining section 10R and the left joining section 10L will be collectively referred to as "right and left joining sections." The right end of the stern joining section 10A is continuous with the rear end of the right joining section 10R, while the left end of the stern joining section 10A is continuous with the rear end of the left joining section 10L (see FIGS. 2 and 3 regarding the left joining section 10L).

Figure 1B:
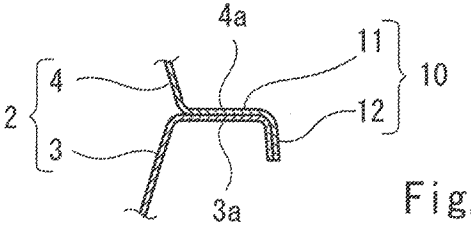

The hull 3 has an upper edge 3*a* which is annularly closed when viewed from above. The deck 4 has a lower edge 4*a* which is annularly closed when viewed from the bottom. As shown in FIG. 1B, each of the upper edge 3*a* of the hull 3 and the lower edge 4*a* of the deck 4 has a hook shape. The lower edge 4*a* is fitted to the upper edge 3*a* from above and joined to the upper edge 3*a* using a joining means such as an adhesive (bonding agent) to form the joining section 10. The joining section 10 includes a horizontal portion 11 protruding horizontally from the body 2 and a vertical portion 12 protruding downward from the outer end portion of the horizontal portion 11.

Turning back to FIG. 1A, the personal watercraft 1 is a stand-up type personal watercraft which is steered by the rider in a standing posture. A standing deck 21 and right and left deck fins 22 are provided at the rear portion of the deck 4. The standing deck 21 is isolated from the engine room 5 by a front wall 23 provided in the deck 4. The deck fins 22 which are provided on the right and left sides of the standing deck 21, respectively, protrude upward and extend in a forward and rearward direction. The front end portions of the deck fins 22 are continuous with the front wall 23. The standing deck 21 is surrounded by the deck fins 22 and the front wall 23, which have a U-shape when viewed from above. When viewed from above, the standing deck 21 has a rectangular shape which is laterally symmetric with respect to a center line of the body 2 in the rightward and leftward direction.

The front end portion of a handle pole 25 is mounted to the front portion of the upper surface of the deck 4 in such a manner that handle pole 25 is rotatable around the front end portion. The handle pole 25 is vertically pivotable around the front end portion thereof. A bar-type steering handle 26 is attached on the rear end portion of the handle pole 25. The handle pole 25 extends in the forward and rearward direction above the engine hood 6. A groove-shaped pole storage section (not shown) is provided in the center portion, in the rightward and leftward direction, of the outer upper surface of the engine hood 6. The handle pole 25 is accommodated in the pole storage section by its own weight and extends substantially horizontally in a state in which the steering handle 26 is not gripped by the rider. The rider boards the standing deck 21 from the rear, stands on the standing deck 21, grips the steering handle 26, and moves the handle pole 25 upward.

While the personal watercraft 1 is planing on the water, the bow is raised and a water flow W moves in the rearward direction along the side surface of the body. The personal watercraft 1 includes a stabilizer 30 to guide the water flow W, which is one of the roles of the stabilizer 30. The stabilizer 30 is mounted to the joining section 10.

Figure 2:
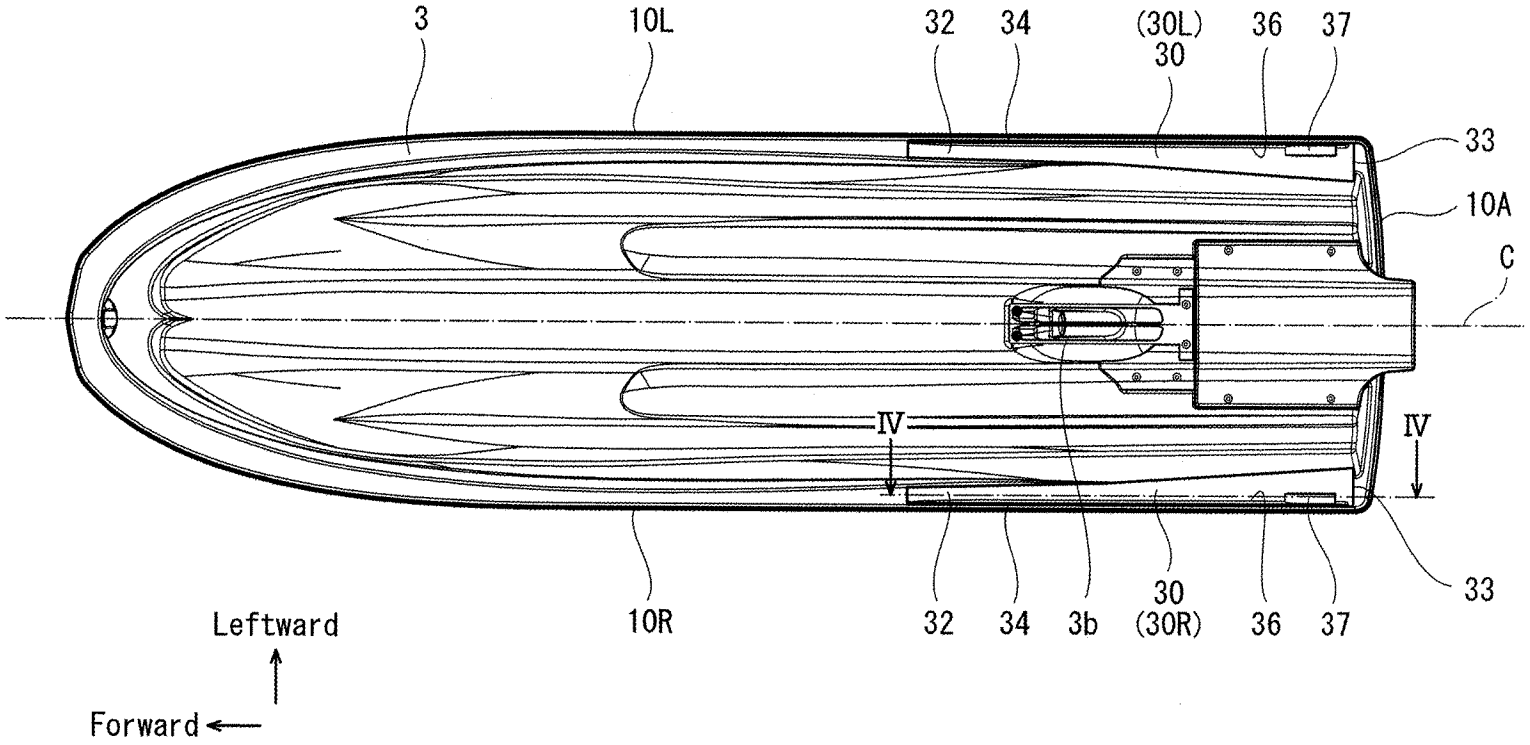
FIG. 2 is a bottom view of a hull and a stabilizer.
Figure 3:
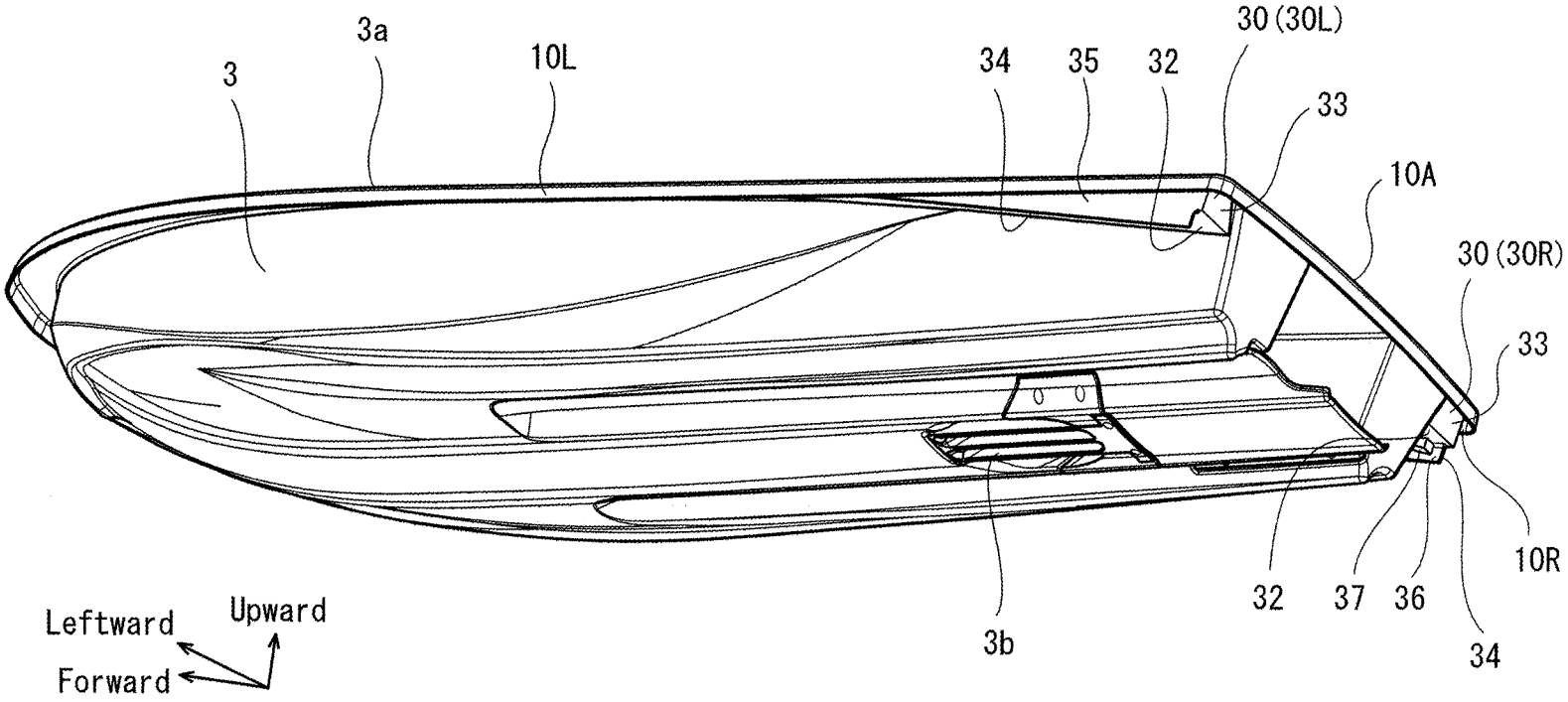
FIG. 3 is a perspective view of the hull and the stabilizer.

As shown in FIGS. 2 and 3, in the present embodiment, right and left stabilizers 30R, 30L are mounted to the rear portion of the right joining section 10R and the rear portion of the left joining section 10L, respectively. The right and left stabilizers 30R, 30L are provided to form a mirror image which is symmetric with respect to the center line C in the rightward and leftward direction. Hereinafter, the right and left stabilizers 30R, 30L will be collectively referred to as "stabilizer 30" when the right and left stabilizers 30R, 30L are not distinguished from each other. The stabilizer 30 is elongated in the forward and rearward direction.

Figure 4:
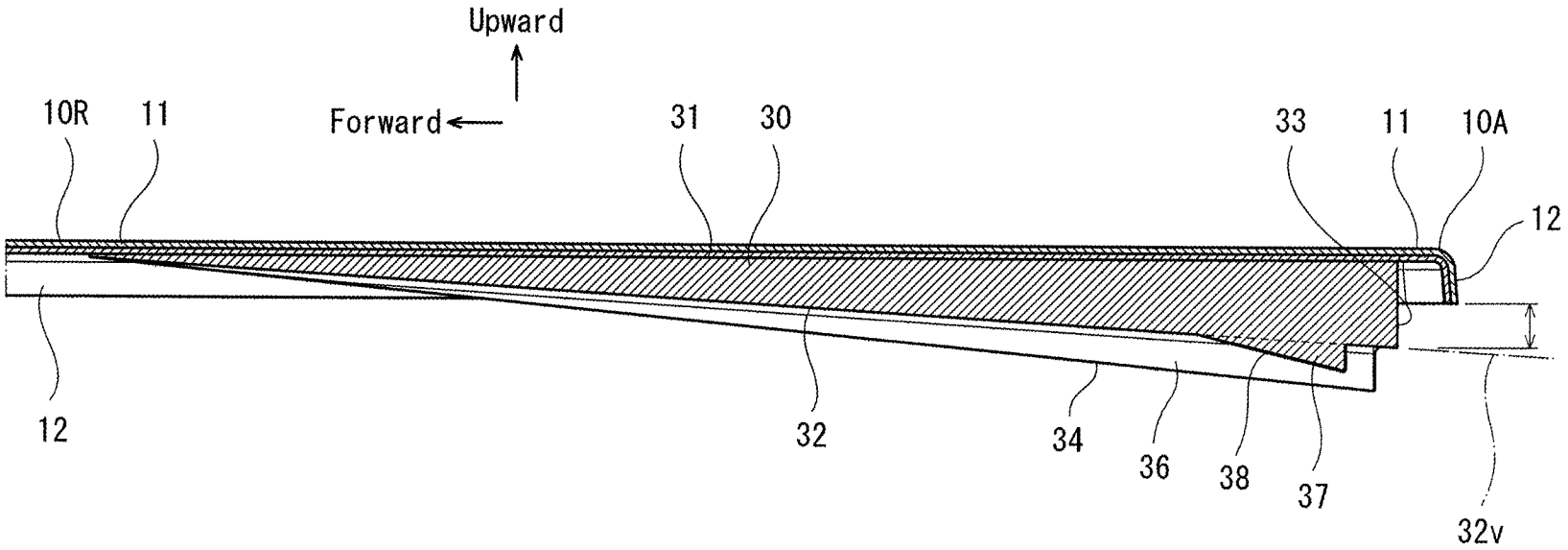
FIG. 4 is a cross-sectional view of a joining section and the stabilizer, which is taken along line IV-IV of FIG. 2.

As shown in FIG. 4, the stabilizer 30 has an upper surface 31 which contacts the bottom surface of the horizontal portion 11, or is located to be close to the bottom surface of the horizontal portion 11 and faces the bottom surface. The stabilizer 30 has an inclined bottom surface 32 which is located below the bottom surface of the horizontal portion 11 and extends in the forward and rearward direction in such a manner that the inclined bottom surface 32 is inclined in a downward direction as it extends in the rearward direction. The stabilizer 30 has a rear surface 33 connecting the rear end of the upper surface 31 to the rear end of the inclined bottom surface 32. The rear surface 33 is bent at a substantially right angle with respect to the upper surface 31. In this structure, the stabilizer 30 has a rectangular triangle shape having a hypotenuse which is the inclined bottom surface 32, when viewed from the side.

A method of fastening the stabilizer 30 to the body 2 is not particularly limited. A bolt (not shown) may be inserted into the stabilizer 30 from outside the stabilizer 30 in the rightward and leftward direction, to inside the stabilizer 30 in the rightward and leftward direction. The bolt may be threadingly engaged with an insert nut provided on the hull 3. In this case, to allow the stabilizer 30 to be easily fastened to the body 2, the stabilizer 30 may be fastened to the body 2 at a portion of the stabilizer 30 which is exposed below the joining section 10. The front edge of the stabilizer 30 is sealingly attached to the bottom surface of the horizontal portion 11. This makes it possible to prevent the water flow W from flowing into a region between the upper surface of the stabilizer 30 and the horizontal portion 11, and guide the water flow W along the inclined bottom surface 32 as described above.

As shown in FIG. 4, when the inclined bottom surface 32 is extended virtually in the rearward direction, a virtual bottom surface 32*v* is formed. The virtual bottom surface 32*v* extends through a region which is below the stern joining section 10A, to be precise, the lower end of the vertical portion 12 of the stern joining section 10A. To be more precise, in the present embodiment, the rear end of the inclined bottom surface 32 is located in front of the inner surface of the vertical portion 12 of the stern joining section 10A and below the stern joining section 10A.

Figure 5:
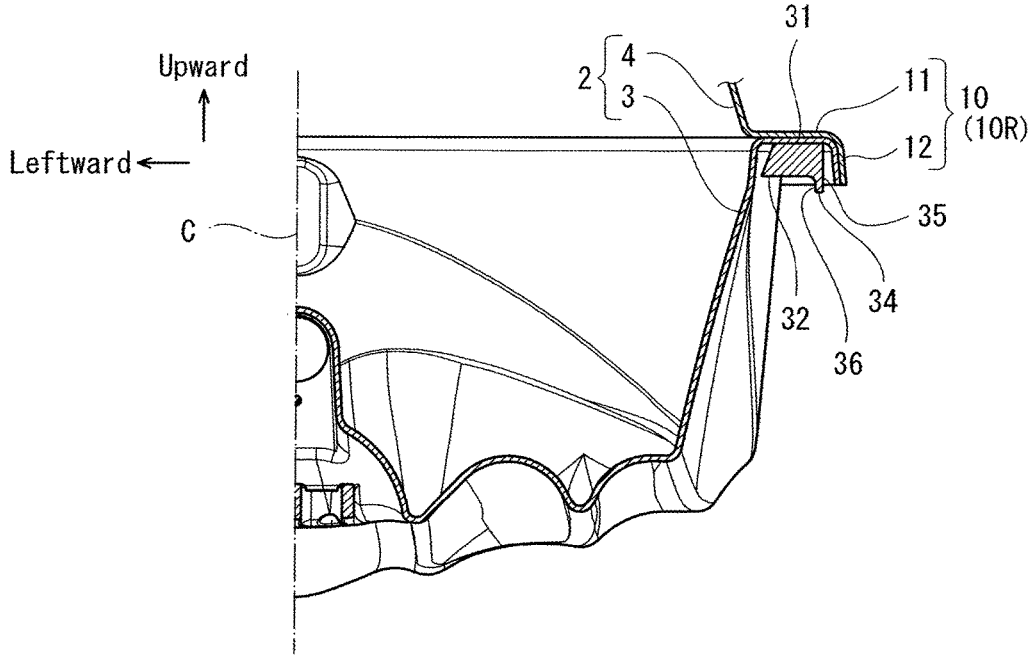
FIG. 5 is a cross-sectional view of the joining section and the stabilizer, which is taken along line V-V of FIG. 1.
Figure 6:
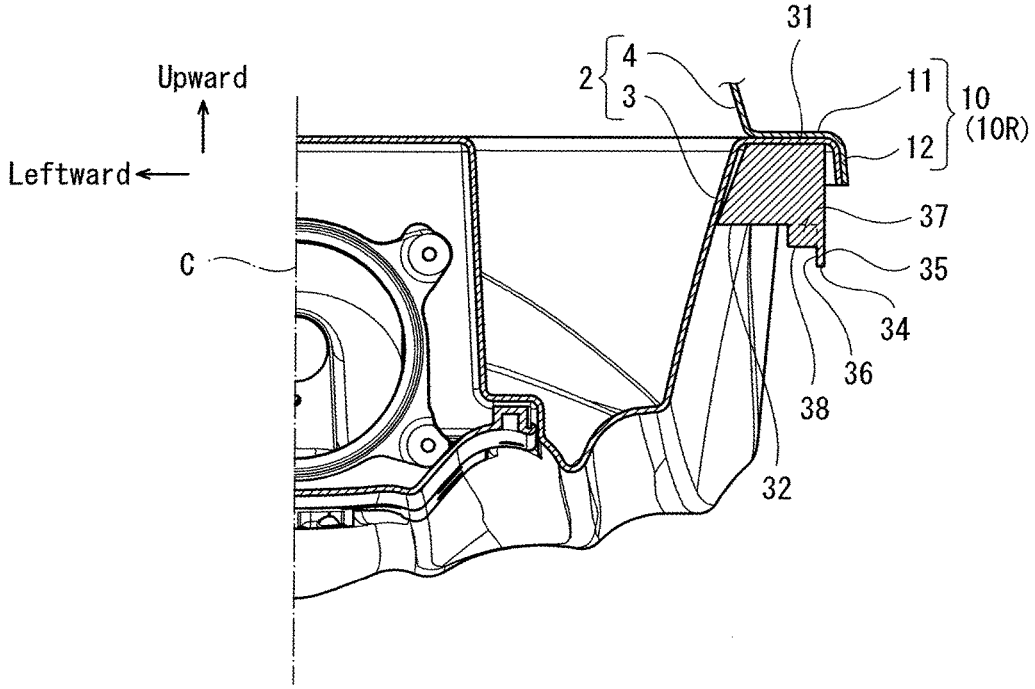
FIG. 6 is a cross-sectional view of the joining section and the stabilizer, which is taken along line VI-VI of FIG. 1.

As shown in FIG. 3, the stabilizer 30 includes an outer side wall 34 protruding downward from the right or left outer edge (right edge in the case of the right stabilizer 30R and left edge in the case of the left stabilizer 30L) of the inclined bottom surface 32. The outer side wall 34 has an outer side surface 35 and an inner side surface 36. The outer side surface 35 extends in the forward and rearward direction at the right or left outer edge of the inclined bottom surface 32, and forms an angle with respect to the upper surface 31 (see FIGS. 5 and 6). The outer side surface 35 has a substantially rectangular triangle shape when viewed from the side. A portion (rear portion) of the outer side surface 35 protrudes downward from the right or left joining section 10R, 10L (see FIG. 1). The inner side surface 36 is on the opposite side of the outer side surface 35. The inner side surface 36 extends downward from the right or left outer edge of the inclined bottom surface 32, and also extends in the forward and rearward direction (see FIGS. 4 and 6).

As shown in FIG. 4, the stabilizer 30 includes a protruding portion 37 protruding inward in the rightward and leftward direction, from the inner side surface 36. The protruding portion 37 protrudes downward from the right or left outer edge of the inclined bottom surface 32 (see FIGS. 3 and 6). The protruding portion 37 is located at the rear portion of the stabilizer 30 (see FIGS. 1 and 4A). A lower surface 38 of the protruding portion 37 extends rearward from the inclined bottom surface 32, and is inclined with respect to the inclined bottom surface 32 in such a manner that the lower surface 38 is separated from the inclined bottom surface 32 in the downward direction as it extends in the rearward direction. The rear surface of the protruding portion 37 connects the rear end of the lower surface 38 to the inclined bottom surface 32, and is substantially parallel to the rear surface 33 of the stabilizer 30. The lower surface 38 of the protruding portion 37 is located below the inclined bottom surface 32, and above the lower end of the outer side wall 34.

As shown in FIG. 1, in the personal watercraft 1 including the above-described stabilizer 30, the water flow W from the bottom of the hull moves in the rearward direction and in the upward direction along the side surface of the hull 3, and then is guided in the rearward direction and gradually in the downward direction along the inclined bottom surface 32 of the stabilizer 30. The inclined bottom surface 32 terminates in front of the stern joining section 10A and is close to the vertical portion of the stern joining section 10A in the forward and rearward direction. The virtual bottom surface 32*v* formed by extending the inclined bottom surface 32 extends through the region which is below the stern joining section 10A. Therefore, the water flow W guided in the rearward direction along the inclined bottom surface 32 moves in the rearward direction away from the inclined bottom surface 32 of the stabilizer 30, but does not collide against the stern joining section 10A. This makes it possible to prevent the water flow W from being exerted on the stern joining section 10A, in particular the inner surface of the vertical portion 12, from the front. As a result, it becomes possible to prevent a situation in which the bow is tilted to the front, and reduce a resistance applied to the body 2, while the watercraft 1 is planing on the water.

In particular, in the present embodiment, the rear end portion of the inclined bottom surface 32 is located below the stern joining section 10A. This makes it possible to more effectively reduce a possibility that the water flow W collides against the stern joining section 10A from the front. In this structure, as shown in FIG. 3, since the rear portion of the stabilizer 30 protrudes to be lower than the stern joining section 10A at the stern, a water wave is easily caught by the stabilizer 30. Thus, the personal watercraft 1 can be moved straight forward and can turn in a stable manner.

As shown in FIG. 1, the rear end portion of the outer side surface 35 of the stabilizer 30 is located below the inclined bottom surface 32. In this structure, the water wave can be more easily caught by the stabilizer 30. In addition, it becomes possible to prevent the water flow W from entering the region between the right and left joining sections 10R, 10L. Therefore, it becomes possible to more effectively reduce a possibility that the water flow W collides against the stern joining section 10A. Further, since the protruding portion 37 protrudes from the inner side surface 36 of the outer side wall 34, the water wave can be even more securely caught by the stabilizer 30. Therefore, the personal watercraft 1 can be steered more easily.

As described above, the stabilizer 30 of the present embodiment can reduce a resistance applied to the body 2 and make steering of the personal watercraft 1 easier.

Although in the above-described embodiment, one stabilizer is provided for each of the right and left joining sections, it is sufficient that the stabilizer is provided for at least one of the right and left joining sections. Although in the above-described embodiment, the personal watercraft 1 is the stand-up type personal watercraft, the personal watercraft 1 may be a runabout-type watercraft including a seat (saddle) straddled by the rider.

The invention claimed is:

1. A personal watercraft comprising:

a body including a hull and a deck;

a joining section including a horizontal portion protruding horizontally from the body, and a vertical portion protruding downward from an outer end portion of the horizontal portion, the joining section extending to surround an entire periphery of the body to join the hull to the deck; and a stabilizer mounted to the joining section, wherein the joining section includes right and left joining sections extending in a forward and rearward direction at a right part and a left part of the body, respectively, and a stern joining section extending in a rightward and leftward direction at a stern of the body, wherein the stabilizer is mounted to a rear portion of at least one of the right and left joining sections, wherein the stabilizer has an inclined bottom surface which is located below a bottom surface of the horizontal portion and extends in the forward and rearward direction in such a manner that the inclined bottom surface is inclined in a downward direction as the inclined bottom surface extends in a rearward direction, and wherein a virtual bottom surface formed by virtually extending the inclined bottom surface in the rearward direction extends through a region which is below the stern joining section.

2. A personal watercraft comprising:

a body including a hull and a deck;

a joining section including a horizontal portion protruding horizontally from the body, and a vertical portion protruding downward from an outer end portion of the horizontal portion, the joining section extending to surround an entire periphery of the body to join the hull to the deck; and a stabilizer mounted to the joining section, wherein the joining section includes right and left joining sections extending in a forward and rearward direction at a right part and a left part of the body, respectively, and a stern joining section extending in a rightward and leftward direction at a stern of the body, wherein the stabilizer is mounted to a rear portion of at least one of the right and left joining sections, wherein the stabilizer has an inclined bottom surface which is located below a bottom surface of the horizontal portion and extends in the forward and rearward direction in such a manner that the inclined bottom surface is inclined in a downward direction as the inclined bottom surface extends in a rearward direction, and wherein a rear end portion of the inclined bottom surface is located below the stern joining section.

3. A personal watercraft comprising:

a body including a hull and a deck;

a joining section including a horizontal portion protruding horizontally from the body, and a vertical portion protruding downward from an outer end portion of the horizontal portion, the joining section extending to surround an entire periphery of the body to join the hull to the deck; and a stabilizer mounted to the joining section, wherein the joining section includes right and left joining sections extending in a forward and rearward direction at a right part and a left part of the body, respectively, and a stern joining section extending in a rightward and leftward direction at a stern of the body, wherein the stabilizer is mounted to a rear portion of at least one of the right and left joining sections, wherein the stabilizer has an inclined bottom surface which is located below a bottom surface of the horizontal portion and extends in the forward and rearward direction in such a manner that the inclined bottom surface is inclined in a downward direction as the inclined bottom surface extends in a rearward direction, and wherein the stabilizer includes an outer side surface extending in the forward and rearward direction at a right or left outer edge of the inclined bottom surface, a rear end portion of the outer side surface is located below the inclined bottom surface, and an amount of a protruding portion of the outer side surface which protrudes downward from the inclined bottom surface is increased in the rearward direction.

4. The personal watercraft according to claim 3, wherein the stabilizer includes an outer side wall having the outer side surface and protruding downward from the inclined bottom surface, and the protruding portion protrudes inward in the rightward and leftward direction, from an inner side surface of the outer side wall, the inner side surface being on an opposite side of the outer side surface.

* * * * *